US007048642B2

(12) United States Patent
Burley

(10) Patent No.: US 7,048,642 B2
(45) Date of Patent: May 23, 2006

(54) GOLF TRAINING DEVICE

(76) Inventor: Paul D. Burley, 4010 Andrew Ct., Abingdon, MD (US) 21009

( * ) Notice: Subject to any disclaimer, the term of this patent is extended or adjusted under 35 U.S.C. 154(b) by 75 days.

(21) Appl. No.: 10/979,191

(22) Filed: Nov. 3, 2004

(65) Prior Publication Data

US 2005/0096146 A1 May 5, 2005

Related U.S. Application Data

(60) Provisional application No. 60/517,440, filed on Nov. 5, 2003.

(51) Int. Cl.
*A63B 69/36* (2006.01)

(52) U.S. Cl. ..... 473/270; 473/220; 473/267

(58) Field of Classification Search ..... 473/2, 473/207, 219–223, 257, 266–268, 270, 271, 473/272; 326/109, 118; 362/120, 191, 259; 345/180, 182, 183
See application file for complete search history.

(56) References Cited

U.S. PATENT DOCUMENTS

| | | | | |
|---|---|---|---|---|
| 4,688,796 | A * | 8/1987 | Wright | 473/2 |
| 4,887,197 | A * | 12/1989 | Effinger | 362/306 |
| 5,207,429 | A * | 5/1993 | Walmsley et al. | 473/220 |
| 5,284,345 | A | 2/1994 | Jehn | |
| 5,307,253 | A * | 4/1994 | Jehn | 362/259 |
| 5,464,222 | A * | 11/1995 | Carney | 473/220 |
| 5,467,992 | A | 11/1995 | Harkness | |
| 5,527,036 | A | 6/1996 | Hutchings et al. | |
| 5,527,041 | A | 6/1996 | Terry, III et al. | |
| 5,544,888 | A | 8/1996 | Pellegrini | |
| 5,632,689 | A | 5/1997 | Duca | |
| 5,655,973 | A | 8/1997 | McPherson, Jr. | |
| 5,665,006 | A | 9/1997 | Pellegrini | |
| 5,709,609 | A | 1/1998 | Carney | |
| 5,722,898 | A | 3/1998 | Witten | |
| 5,725,440 | A | 3/1998 | Finney | |
| 5,733,202 | A | 3/1998 | Vargo | |
| 5,788,582 | A | 8/1998 | Shapiro | |
| 5,800,279 | A | 9/1998 | Densberger et al. | |
| 5,810,674 | A | 9/1998 | Falossi et al. | |
| 5,848,944 | A | 12/1998 | Brannen | |
| 5,860,871 | A | 1/1999 | Marley, Jr. | |
| 5,938,539 | A | 8/1999 | Hamilton | |
| 5,964,668 | A | 10/1999 | Tai et al. | |
| 5,993,026 | A * | 11/1999 | Wu | 362/259 |
| 6,004,220 | A | 12/1999 | Razzano | |
| 6,059,668 | A | 5/2000 | Marley, Jr. | |
| 6,071,202 | A | 6/2000 | Densberger et al. | |
| 6,123,626 | A | 9/2000 | Osborn | |

(Continued)

FOREIGN PATENT DOCUMENTS

| | | |
|---|---|---|
| CA | 2332659 | 7/2002 |

(Continued)

*Primary Examiner*—Nini F. Legesse
(74) *Attorney, Agent, or Firm*—Rosenberg, Klein & Lee

(57) ABSTRACT

A golf training device (10) is provided having an elongated housing (20) and a mirror housing (30), with both the elongated housing (20) and mirror housing (30) having indicia (40) imprinted thereon. The elongated housing (20) contains a laser (200) and a mirror assembly (150) for generating a laser beam (80) which is projected in a direction perpendicular to the longitudinal axis of the elongated housing (20). The laser beam (80) instructs a user on where to position the heel of his or her leading foot (290) and indicia (40) allow for the proper positioning of the golf ball (240) with respect to a chosen golf club for an optimal swing to reach a designated target.

23 Claims, 5 Drawing Sheets

U.S. PATENT DOCUMENTS 6,155,929 A * 12/2000 Chipman ..... 473/2
6,206,787 B1 3/2001 Kleppen
6,213,887 B1 4/2001 Carney
6,227,982 B1 5/2001 Wurster
6,254,493 B1 7/2001 Wurster
6,383,087 B1 5/2002 Moser
6,386,988 B1 5/2002 Shearer et al.
6,450,893 B1 9/2002 Primiano et al.
6,482,099 B1 * 11/2002 Schaum ..... 473/220
6,663,496 B1 12/2003 Cameron et al.
6,669,574 B1 12/2003 Riley et al.
6,672,972 B1 1/2004 Stone
6,695,709 B1 2/2004 Ottensmeyer
6,758,760 B1 7/2004 Kellogg et al.
6,796,910 B1 * 9/2004 Foster ..... 473/220
2002/0123385 A1 9/2002 Primiano et al.
2003/0045368 A1 3/2003 Farmer et al.
2004/0106462 A1 6/2004 Ianazone

FOREIGN PATENT DOCUMENTS

GB 2379888 3/2003

* cited by examiner

GOLF TRAINING DEVICE

The subject Utility Patent Application is based on Provisional Patent Application No. 60/517,440, filed on 5 Nov. 2003.

BACKGROUND OF THE INVENTION

1. Field of the Invention

The subject invention relates to a golf training device. In particular, the present invention directs itself to an elongated housing containing a laser and a mirror assembly. More particularly, this invention directs itself to a laser-based system for projecting a laser beam onto the heel of the leading foot of a user in order to properly position the user when the elongated housing is aligned with a selected target, such as a golf hole.

Further, the elongated housing is imprinted with indicia, with the indicia denoting the proper position of a golf ball for a selected golf club. Additionally, this invention directs itself to a pair of collapsible ground spikes for insertion into the ground and support of the elongated housing.

2. Prior Art

Laser-based golf training devices are well-known in the art. In general, such prior art training systems utilize a laser targeting device for either targeting the ball, in order to keep the golfer's stance steady, or targeting a specific target, such as the golf green. The prior art laser-based devices for maintaining a golfer's stance are often mounted on the golfer's body or golf club, and are thus subject to the movement of the golfer and include an inherent instability in targeting. The prior art laser-based systems which target a golf green or hole, for example, only transmit the laser beam towards the specific target and are not instructional with regard to the proper stance of the golfer. It is a purpose of the subject invention to provide a combination of elements making a laser-based golf training device which is stably mounted for instructing the golfer on the proper stance for a selected golf club. The present invention provides the combination of a ground-supported stable laser targeting system for guiding the user in the proper stance for a golf swing with a set of instructional indicia printed on the elongated housing of the golf training device in order to provide proper positioning of the golf ball with respect to a selected golf club.

One such prior art golf training device is shown in U.S. patent application Publication Ser. No. 2004/0106462. This reference is directed to a laser putting aid and associated method. In this reference, the laser is mounted on the body of the golfer and is used, primarily, in order to adjust the golfer's posture or stance. The laser is free to move based upon the movements of the golfer. In the system of the subject Patent Application, the laser is stably mounted on the ground, and thus does not move, and further, is directed to illuminating the proper stance and placement of the golf ball for a selected type of golf club.

Another such prior art laser-based golf training device is shown in U.S. Pat. No. 6,450,893. This reference is directed to an apparatus for providing a laser alignment golf training aid. The training system includes a golf club-mounted targeting laser for targeting the golf hole. The laser is mounted on the golf club and is, thus, movable when the golf club swings and is further subjected to the various stresses provided by the swing of the golf club. In contradistinction, the golf training device of the subject Patent Application system is stably mounted on the ground and, thus, does not move and has no external stresses exerted thereon. Further, the present invention is not a targeting system for the golf hole, but is used as an instructional aid for the proper positioning of the golfer's feet or stance. Additionally, U.S. Pat. No. 6,450,893 does not provide for an instructional guide for the positioning of the golf ball for a selected golf club.

Another such prior art device is shown in U.K. Patent Application GB 2379888 A. This reference is directed to a laser/light emitting golf training aid. This prior art system utilizes a weighted simulated golf grip having a laser in order to teach proper swing technique. The laser is mounted in the simulated grip, and is, thus, movable. In contradistinction, the system of the subject Patent Application utilizes a stable and stationary laser in order to aid a golfer in the proper positioning of his feet for maintaining a proper golf swing.

U.S. Pat. No. 6,071,202 is directed to a golf swing training method. This system is an optically based system for creating a visible swing path with projected light. Though the system is stationary, this reference teaches a device for aiding a golfer with proper swing technique and is not directed to the positioning of the golfer's feet. The system of the subject Patent Application utilizes a laser in order to properly position the golfer's lead foot, and further offers positional guidance in the placement of the golf ball based upon the choice of the golfer's golf club.

None of the prior art provides for a combination of elements forming a laser-based golf training device which is not only stationary, but insertable in the ground adjacent the golf tee. Additionally, none of the prior art references teach or suggest a system which is used for illuminating the heel of the lead foot of the golfer in order to provide instruction in the proper placement of the feet during a golf swing. Additionally, none of the prior art references teach instruction in ball placement based upon the choice of the golf club.

SUMMARY OF THE INVENTION

The present invention provides for a golf training device having an elongated housing for receiving both a laser and a mirror assembly. The mirror reflects the laser beam generated by the laser through an aperture in the elongated housing along a direction substantially orthogonal or perpendicular to the longitudinal axis of the elongated housing. The laser beam is projected onto the leading foot of a user in order to properly position the user when the longitudinal axis of the elongated housing is aligned with a selected target, such as a golf fairway, hole, green, or any other target.

It is a principal objective of the subject golf training device to provide an elongated housing having first and second longitudinally opposed ends defining a longitudinally directed passage which receives a laser and a mirror assembly.

It is a further objective of the subject invention to provide a golf training device having a mirror assembly which is rotatable with respect to the elongated housing.

It is a further objective of the subject invention to provide a golf training device having indicia imprinted on the elongated housing, with the indicia including a directional pointer for aligning the elongated housing with a target.

It is an additional objective of the subject invention concept to provide a golf training device having indicia denoting positions for placement of a golf ball dependent upon a choice of golf club.

It is a further objective of the present invention concept to provide a pair of projecting spikes secured to the elongated housing, with the projecting spikes being collapsible and being insertable into the ground and providing support for the elongated housing.

It is an important objective of the present invention to provide a golf training device which projects a laser beam onto the heel of the leading foot of a user in order to properly position the user when the longitudinal axis of the elongated housing of the golf training device is aligned with a selected target.

DESCRIPTION OF THE PREFERRED EMBODIMENTS

Figure 1:
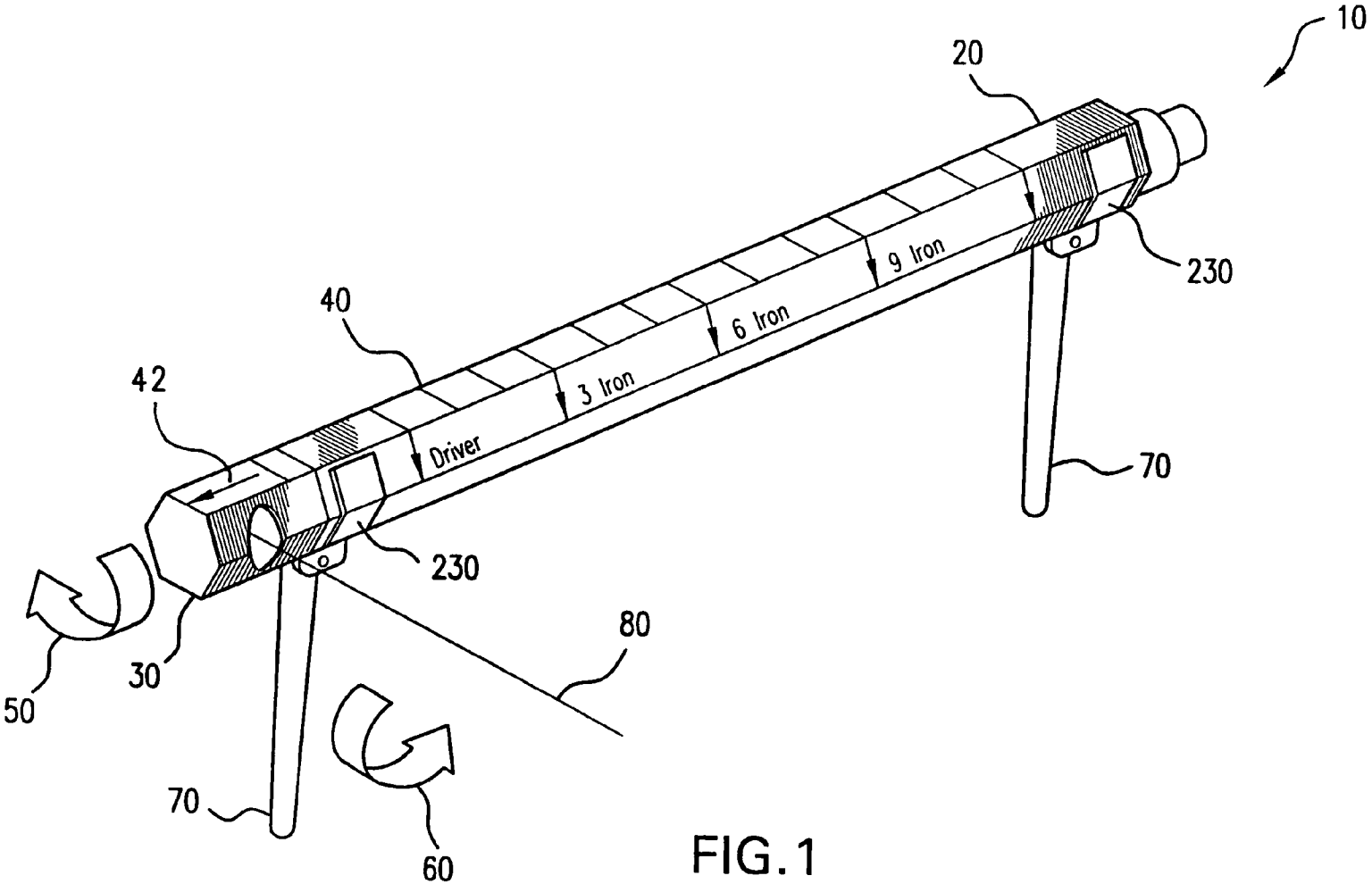
FIG. 1 is a perspective view of the subject golf training device.
Figure 2:
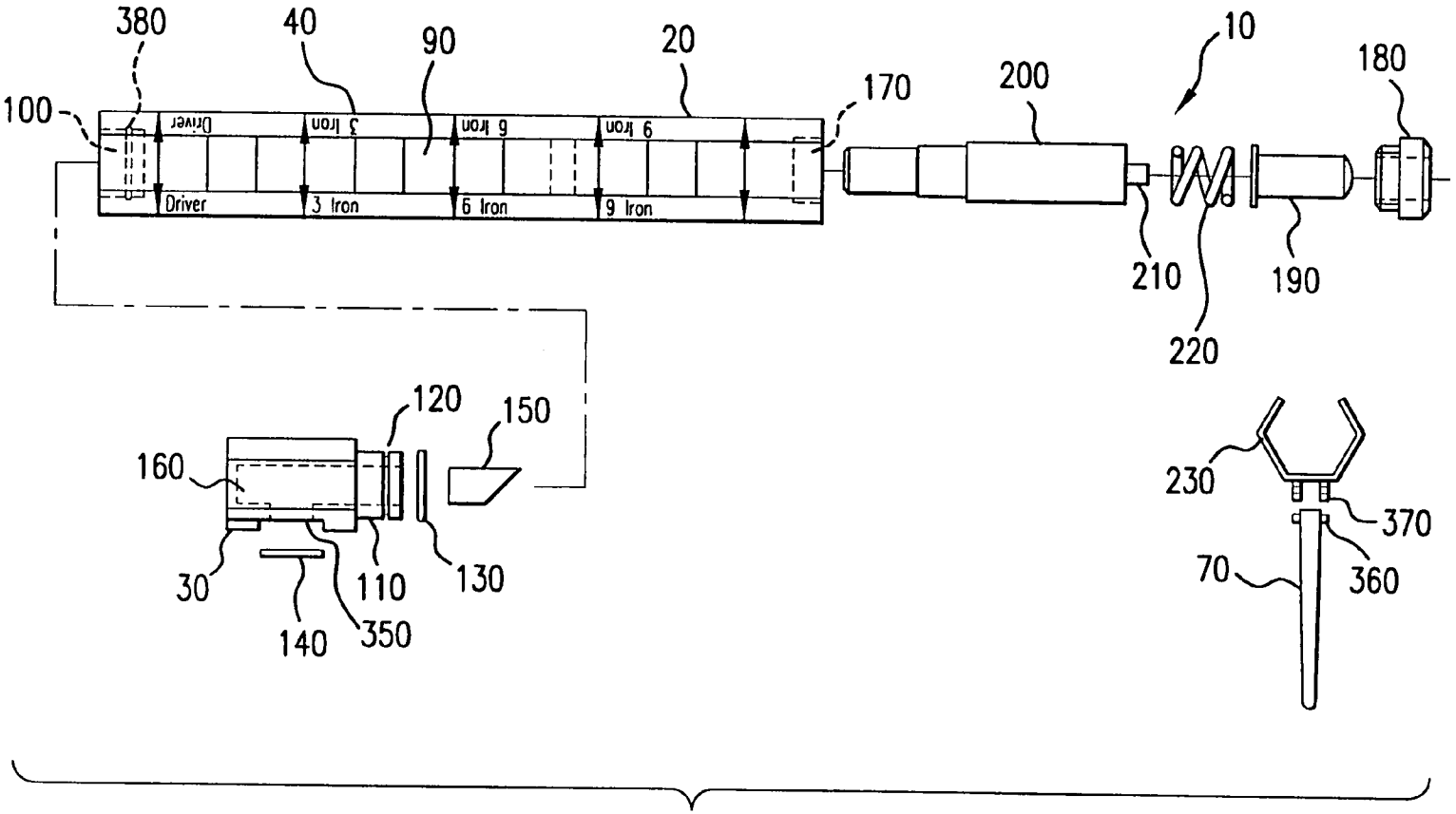
FIG. 2 is an exploded view of the golf training device.
Figure 3:
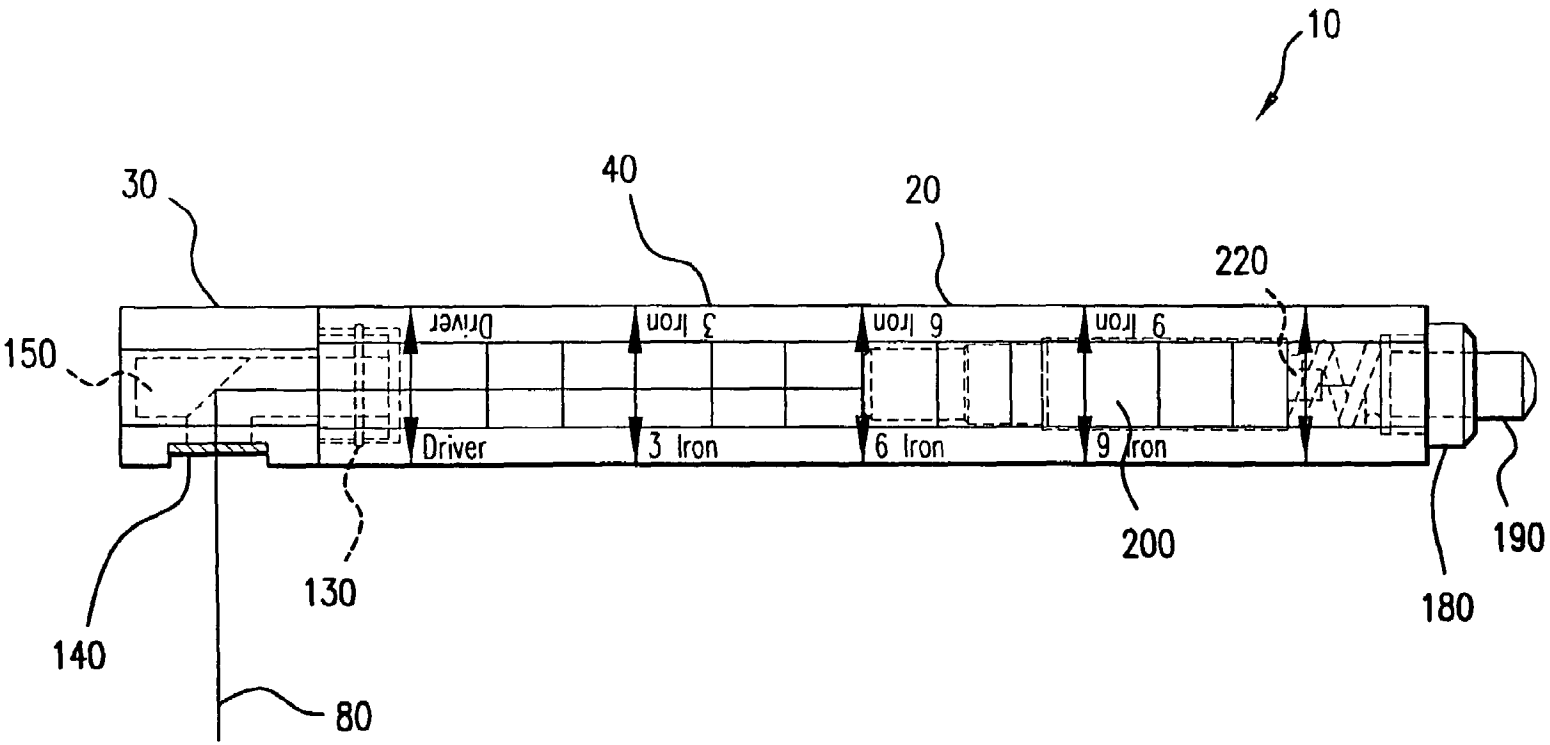
FIG. 3 is a cut-away view of the assembled golf training device.
Figure 5B:
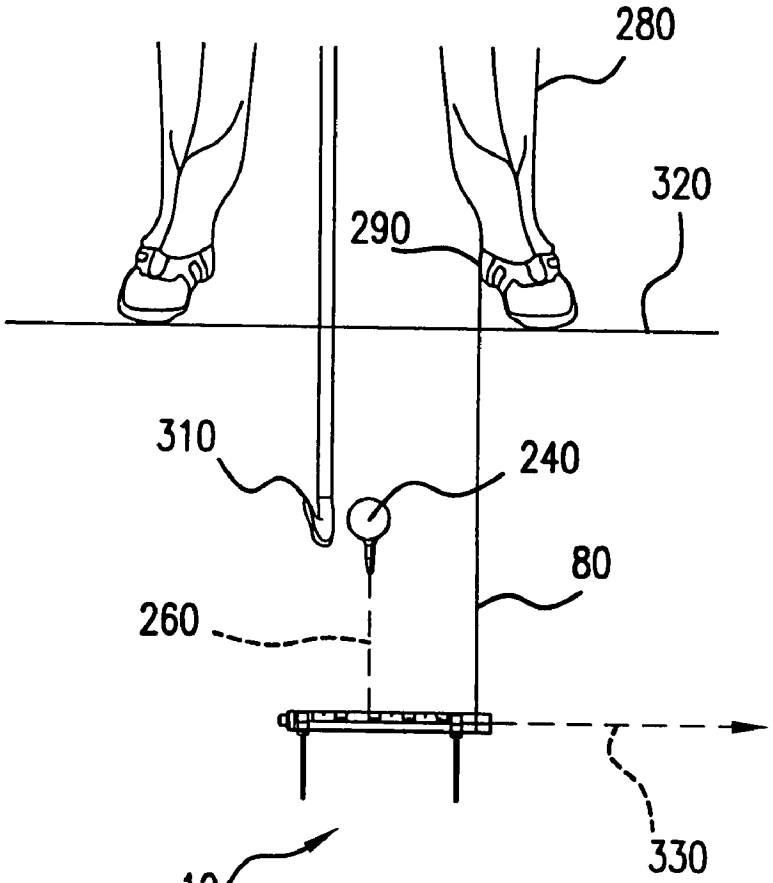
FIG. 5A illustrates a user utilizing the golf training device with a first choice of golf club; and, FIG. 5B illustrates a user utilizing the golf training device with a second choice of golf club.
Figure 5A:
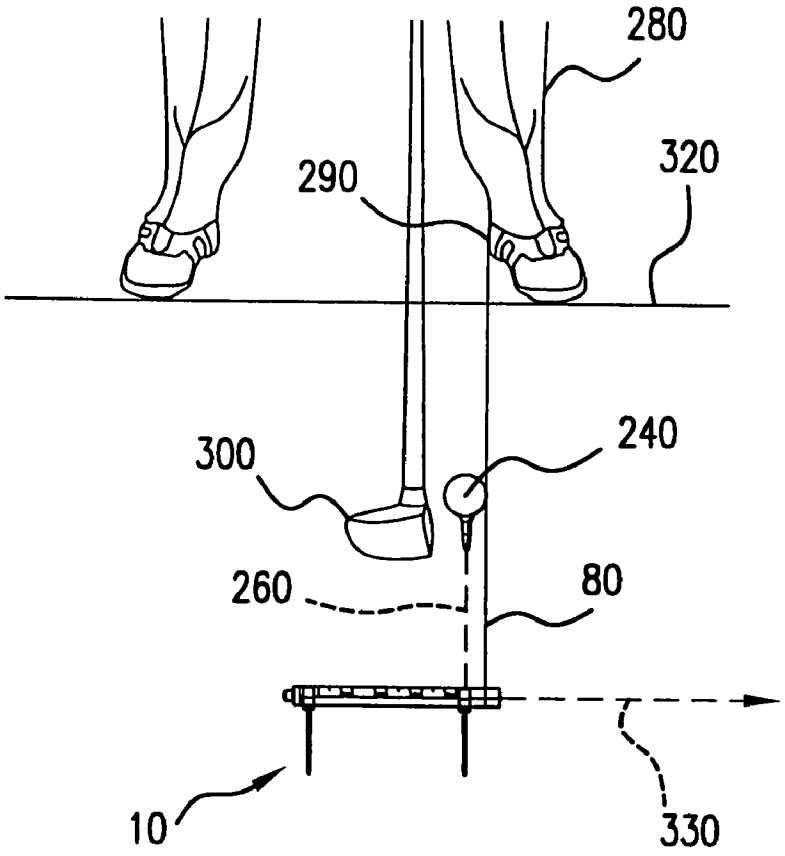

Referring now to FIGS. 1–3, there is shown a golf training device 10 having a laser assembly 200, a mirror 150, and an elongated outer housing 20 for containing the laser 200. As shown in FIG. 1, the laser 200 produces a laser beam 80 in a direction substantially orthogonal or perpendicular to a longitudinal axis of the elongated housing 20. As shown in FIGS. 5A and 5B, laser beam 80 is directed to the heel of the leading foot 290 of user 280 in order to teach the user the proper foot placement when playing golf.

Golf training device 10 includes indicia 40 formed on the external surface of elongated outer housing 20. As shown in FIG. 1, indicia 40 includes a directional arrow 42 for alignment of the golf training device 10 with a target, such as a golf fairway, green, hole, or any other target. The golf training device 10 is stably mounted in the ground by the insertion of ground spikes 70. The laser beam 80 projected by laser 200 is used to guide the golfer in the user's preferred stance for a golf swing when the golf training device 10 is aligned with the target. As illustrated in FIGS. 5A and 5B, laser beam 80 impinges upon the heel 290 of the leading foot of golfer 280. Additionally, indicia 40 include grading marks and descriptive indicia, illustrating for the user 280 the user's selected positioning of the golf ball 240 for a selected choice of golf club, as will be described below.

As best shown in FIG. 2, the golf training device 10 includes an elongated housing 20 having indicia 40 imprinted thereon. The indicia, in the form of rading marks and words, including "Driver", "3 Iron", "6 Iron", and "9 Iron", for example, allow the user to properly position the golf ball 240 (as shown in FIGS. 5A and 5B) for each selected choice of golf club, or based on the user's preference. Although these specific words and terms are illustrated in FIGS. 2 and 3, any suitable instructional indicia 40 may be imprinted on the elongated housing 20.

The elongated housing 20 has an elongated cavity 90 formed therethrough for receiving laser 200. Laser 200 is a standard commercial laser, such as a laser pointer-type laser assembly, and includes a standard actuator 210 formed on one end thereof. As shown in FIGS. 2 and 3, a pushbutton actuator 190 is provided for contacting on/off switch 210 of laser 200. An elastic element, such as a coil spring 220, biases pushbutton actuator 190 from laser 200 and against retaining ring 180. As shown in FIG. 2, a retaining ring recess or bore 170 is formed adjacent one end of elongated housing 20 for receiving the projecting region of retaining ring 180, thus holding the pushbutton actuator 190 in place with the pushbutton actuator 190 being biased against the retaining ring 180 by elastic element 220.

The golf training device 10 further includes a mirror housing 30 having a main body portion and a mirror housing projecting portion 110. As shown in FIG. 2, a mirror assembly 150 is received and fixedly secured within a mirror receiving cavity 160 of the mirror housing 30. An aperture 350 is formed through the mirror housing 30 and a transparent window or lens 140 may be received within the aperture 350.

Both the elongated housing and the mirror housing are shown having hexagonal cross-sectional contours in the Figures. Although this is the preferred cross-sectional configuration, it should be understood that the elongated housing and the mirror housing may have any suitable cross-sectional contour. Additionally, the elongated housing and mirror housing may be formed of any suitable material, however, in the preferred embodiment, the elongated housing and mirror housing are constructed from aluminum in order to provide high tensile strength coupled with a relatively low mass, allowing for portability of the device 10. Rigid extruded aluminum or solid aluminum may be utilized in the preferred embodiment. Additionally, any suitable metal or plastic molded material may be used for the formation of the golf training device 10.

A mirror housing recess or bore 100 is formed in the elongated housing 20 adjacent the end longitudinally opposed from the retaining ring recess 170. The recess or bore 100 receives the mirror housing projecting region 110. The mirror housing projecting region 110 has an annular gasket recess 120 formed therein for receiving gasket or O-ring 130. The mirror housing recess or bore 100 has a corresponding annular recess 380 formed therein for engaging the gasket or O-ring 130, thus allowing the mirror housing 30 to rotatably and releasably engage the main elongated housing 20, as shown in FIG. 3.

In the Figures, the mirror housing recess or bore 100 is illustrated as being a cylindrical recess. It should be understood that the recess may have any suitable contour, such as a square cross-sectional contour, for example, however, the circular or cylindrical bore is used in the preferred embodiment due to the ease of rotation of the mirror housing with respect to the elongated housing. As will be described in later sections, mirror housing 30 is rotatable with respect to elongated housing 20, thus allowing laser beam 80 to be projected in multiple directions. In the preferred embodiment, the projecting portion 110 and the bore 100 both have circular cross-sectional contours in order to provide 360° of rotation. The rotatable functionality of mirror housing 30 is provided in order to allow both left-handed and right-handed golfers to use the golf training device 10 properly.

Further, as shown in FIG. 2 of the Drawings, the aperture 350 for window 140 is shown as having a stepped contour. This is for the secure placement of window 140 within aperture 350. Window 140 is fixedly secured to aperture 350 to provide protection of the optical elements housed within elongated housing 20 from both external mechanical forces and from environmental contamination.

Further shown in FIG. 2 of the Drawings, the mirror 150 is illustrated as having a trapezoidal cross-section. In the preferred embodiment, the mirror 150 has a trapezoidal cross-section with the mirror being positioned at a 45° angle from the longitudinal axis of the elongated housing, however, the mirror may have any suitable configuration, such as a plane mirror, for example. The mirror preferably is positioned at 45° with respect to the longitudinal axis of the elongated housing in order to reflect the light beam 80 generated by laser 200 through the aperture 350 and window 140 along a direction perpendicular to the longitudinal axis of the elongated housing.

The mirror 150 may be constructed of rigid extruded or solid aluminum, or any other suitable metal or plastic molded material. The mirror assembly 150 should be highly polished or coated with a reflective material in order to allow for proper reflection of the light beam generated by laser 200.

As illustrated in FIG. 3, the laser beam 80 reflects off of mirror 150 in order to be projected through window or lens 140. The window or lens 140 may have a circular cross-section, such as that shown in the preferred embodiment of FIG. 4, or may be shaped to any suitable cross-sectional contour. The window 140 acts as a protective cover for the optics of the golf training device 10 and is constructed of a plastic or glass material, which must be transparent to the laser beam 80.

As shown in FIGS. 2 and 3, the gasket or O-ring 130 is received within annular recess 120. The O-ring is a standard gasket or O-ring constructed of flexible rubber or plastic material.

Further, with regard to the optics of golf training device 10, laser 200 may be any suitable commercially available laser, however, in the preferred embodiment, a laser having a maximum output of less than 5 mW and a wavelength of 650 nm is utilized. The laser 200 is preferably a Class IIIA laser product having, preferably, an internal power supply, such as commercially available batteries. As illustrated in FIG. 2, the retaining ring 180 is received by the retaining ring recess 170, allowing the laser 200 to be removed from the elongated housing 20. Thus, the laser may be replaced, or the power supply of the laser may be replaced, when necessary.

The laser 200 is actuated by the on/off pushbutton actuator 190, which may be constructed of rigid extruded or solid aluminum, or any other chromium coated metals or plastic molded materials having a flange formed at one end in order to provide a positive flat surface for the power button 210 to be compressed, upon actuation. The spring or elastic element 220, which is positioned between laser 200 and the pushbutton actuator 190, biases the actuator 190 against the retaining ring 180; and may be formed of any commercially available spring steel material.

The retaining ring 180 illustrated in FIGS. 2 and 3 is a cylindrical pushbutton retaining screw cap. The retaining ring 180 may be constructed of solid aluminum, chromium, or other metal, or plastic molded materials. The retaining ring 180 has a hole or passage formed through the center and is contoured to receive the pushbutton actuator 190. The projecting region of the retaining ring 180 may be threaded and, likewise, the retaining ring recess 170 may also be formed with corresponding threads in order to provide a threaded connection for releasable engagement of retaining ring 180 with the recess 170 of the elongated housing 20.

Figure 4:
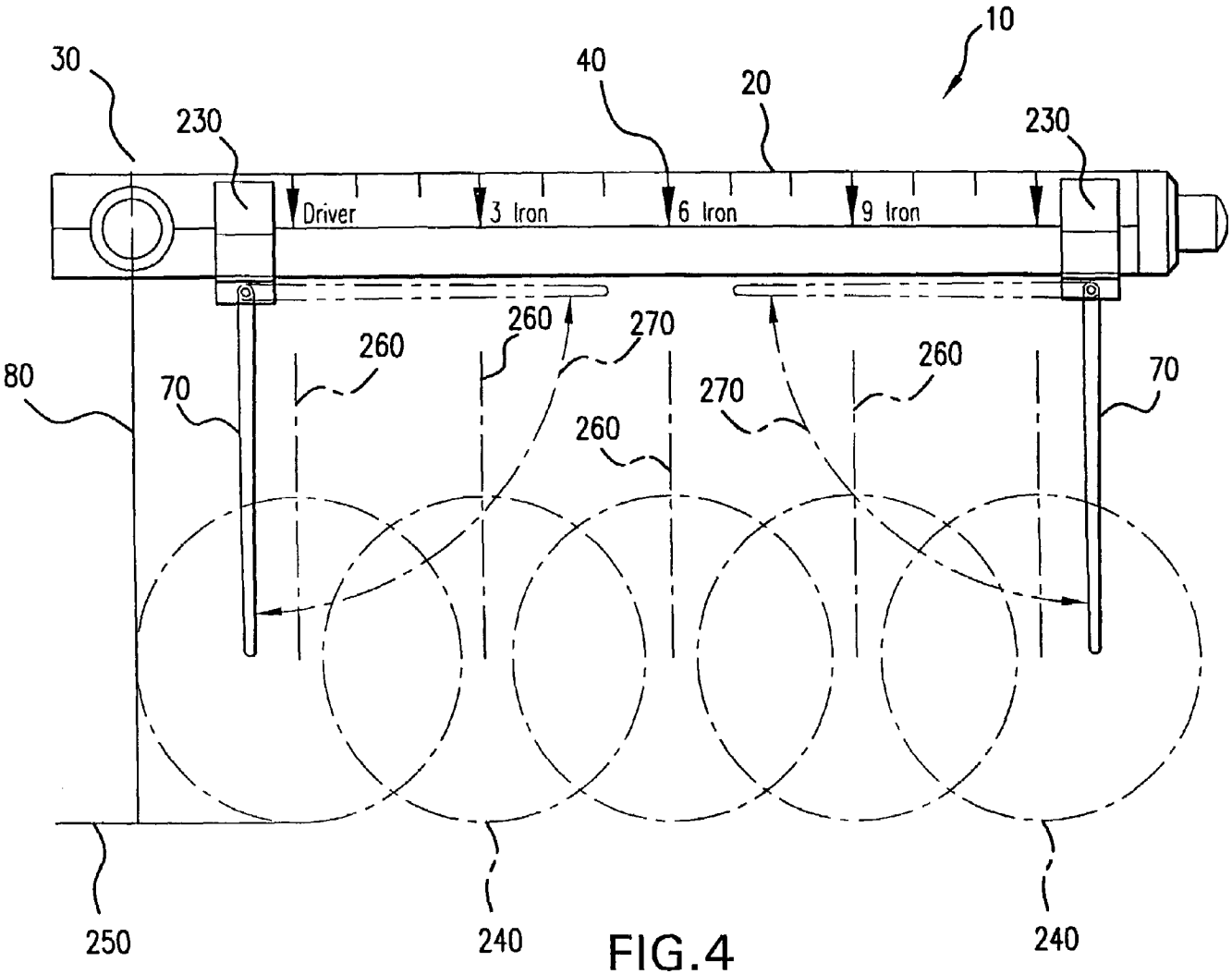
FIG. 4 is a side view of the golf training device showing the variable positioning of a golf ball with respect to the golf training device.

The ground spikes 70 illustrated in FIGS. 2 and 4 may be constructed of aluminum or other metals. The ground spikes taper at a lower end, as shown in FIG. 2, in order to easily pierce the ground. As best shown in FIG. 2, the upper end of each ground spike 70 includes a pair of engaging rods or pins 360 which pivotally engage the mounting bracket 230 at pivotal receiving portions 370. As shown in FIG. 2, the mounting bracket 230 has a contour corresponding to the cross-sectional contour of the elongated housing, in the preferred embodiment shown as being a hexagonal cross-sectional contour.

Although FIGS. 5A and 5B illustrate the golf training device being utilized by a user having a right-handed stance, the mirror housing 30 may be rotated by 180°, with respect to the elongated housing 20, in order to provide the same functionality for a left-handed stance. Rotation of the mirror housing is illustrated in FIG. 1 by directional arrows 50, 60.

Additionally, as shown in FIGS. 2 and 4, a pair of ground spikes 70 are provided, with the ground spikes 70 being removably insertable into the ground, as shown in FIGS. 5A and 5B. The ground spikes 70 support the golf training device 10 when in use and are pivotally coupled to a respective pair of retaining brackets 230. The retaining brackets 230 are fixedly secured to the elongated housing 20, with the ground spikes 70 being pivotally joined to the retaining brackets 230. Thus, the ground spikes are collapsible, as illustrated by the directional arrows 270 of FIG. 4, thus allowing for easy transport of the golf training device 10.

In use, the user deploys the ground spikes 70 into their ground engaging positions, shown in FIG. 1 of the Drawings, and inserts the ground spikes 70 into the ground, as shown in FIGS. 5A and 5B. The user may then rotate the mirror housing 30 to adjust the system for left-handed use or right-handed use, as illustrated by the directional arrows 50, 60, respectively, in FIG. 1.

The user actuates the laser 200 by use of the pushbutton actuator 190 in order to generate laser beam 80. As best shown in FIG. 3, the laser beam is reflected from the mirror 150 and is projected through the transparent window or lens 140, seated in the aperture 350 formed through the mirror housing 30. The laser beam 80 is projected in a direction substantially orthogonal or perpendicular to the longitudinal axis of the elongated housing 20.

As shown in FIG. 1, indicia 40 may include a directional arrow imprinted on mirror housing 30, with the directional arrow pointing in a direction parallel to the longitudinal axis of the elongated housing 20.

As shown in FIGS. 5A and 5B, the directional arrow is aligned along line 330 to point towards a specific target, such as the golf fairway, green, golf hole, or any other target. In order to make a proper swing, the user 280 aligns his or her feet along a reference line 320 which is parallel to the targeting line 330, as shown in FIGS. 5A and 5B. The golf training device 10 produces laser beam 80 and user 280 aligns the heel of his or her leading foot 290 to intersect with the laser beam 80, or a reference point generated by the laser beam, striking the ground in front of user 280. The laser beam 80 illuminates the proper foot position for user 280 when the training device 10 is properly aligned with the target.

Golf ball 240 is positioned on a golf tee a set distance from the golf training device 10 (illustrated by horizontal line 250 in FIG. 4), and the center of the golf ball 240 is aligned with the corresponding indicia 40 formed on the elongated housing 20. Alternatively, if golf ball 240 is in the fairway the training device 10 is positioned with the center of the golf ball 240 aligned with indicia 40 formed on elongated housing 20. For example, FIG. 5A illustrates the golfer 280 using a driver 300. The center of the golf ball is aligned with the directional arrow labeled "Driver" of indicia 40. In FIG. 5B, the user is using a 3 Iron 310 and, thus, aligns the center of golf ball 240 with the directional arrow for "3 Iron" of indicia 40. Thus, the user attains the optimal positioning of his or her leading foot 290 with respect to the golf ball and for the chosen golf club.

The indicia 40 formed on elongated housing 20 may have any color or preferred stylization. As shown in FIGS. 1, 2, and 3, in the preferred embodiment, the indicia 40 include directional arrows for positioning of the golf ball. The directional arrows have pointers directed in both directions, so that the golf training device 10 may be utilized by either a left-handed or right-handed golfer, along with the corresponding proper rotation of the mirror housing with respect to the elongated housing.

The first arrow, labeled "Driver" in the Figures, is positioned approximately half of the diameter of a standard golf ball from projected laser beam 80. The second arrow, labeled "3 iron", is positioned preferably approximately 1 inch from the "Driver" arrow. The third arrow, shown in the Figures, and labeled "6 iron" is positioned preferably approximately 1 inch from the "3 iron" arrow. The fourth illustrated arrow, labeled "9 iron", is preferably approximately 1 inch from the "6 iron" arrow. The fifth arrow, illustrated in the Figures, is positioned preferably approximately 1 inch from the "9 iron" arrow. All of the imprinted words of indicia 40 may be of any size, type or font and it should be noted that two unlabeled lines are shown positioned between each labeled line, such as "Driver" lines, thus indicating additional ball position center lines which may be used for selected golf clubs.

It should further be noted that in the preferred embodiment, the arrow markings of indicia 40, when viewed from above, appear to stretch along the full width of the elongated housing 20.

In operation, the golf device 10 is placed in the ground and aimed at a particular target using the arrow marking of indicia 40 which is directed along the longitudinal axis of the elongated housing and is shown being aligned in direction 330 in FIGS. 5A and 5B. The device is inserted into the ground by ground spikes 70, which may be folded out from their collapsed position, as illustrated by directional arrows 270 in FIG. 4.

The mirror housing 30 may be rotated, as illustrated by directional arrows 50, 60 in FIG. 1, in order to accommodate either a right-handed or left-handed golfer, with the directional arrow markings of indicia 40 facing upward. The laser 200 is turned on through the actuation of pushbutton actuator 190, which contacts the laser-mounted on/off switch 210. Laser beam 80 is subsequently emitted in a direction substantially orthogonal or perpendicular to the longitudinal axis of the elongated housing 20.

As illustrated in FIGS. 5A and 5B, the golf ball is mounted on a tee or positioned on the ground and is aligned with the center of the golf ball 240, which is positioned using the corresponding arrow or mark of indicia 40 for the intended club to be used, illustrated by alignment line-segment 260 in FIGS. 5A and 5B. When the golfer is positioning himself or herself for the shot, the emitted laser is reflected on the inside of the user's leading foot heel 290, or the reference point generated by the laser beam striking the ground in front of user 280. The trailing foot of the golfer stance, as illustrated in the Figures, is positioned squarely or parallel to the device 10, thus aligning the shoulders of the golfer's body and the feet of the golfer parallel to the targeting line 330 while maintaining the correct position of the ball 240 in relation to the heel 240 of the leading foot. The stance position of the golfer is also aligned parallel to the target, illustrated by alignment arrow 330, thus ensuring that the club face makes proper square contact with the ball at the point of impact, resulting in the ball's trajectory in a line parallel to alignment direction 330 and, ultimately, toward the selected target.

The golf training device 10 provides an instructional aid for golfers for both guiding the golfer in the proper stance for a golf swing when the golf training device 10 is aligned along a selected directional path, and also for guiding the golfer in the proper positioning of the golf ball for a chosen type of golf club.

Although this invention has been described in connection with specific forms and embodiments thereof, it will be appreciated that various modifications other than those discussed above may be resorted to without departing from the spirit or scope of the invention. For example, functionally equivalent elements may be substituted for those specifically shown and described without departing from the spirit or scope of the invention as defined in the appended claims.

What is claimed is:

1. A golf training device comprising:

an elongated housing having first and second longitudinally opposed ends defining a longitudinally directed passage, said second end of said elongated housing being an open end;

a mirror housing having opposing open and closed ends, said open end of said mirror housing being to be rotatively displaceable with respect to the second end of said elongated housing, said mirror housing having an aperture adjacent to said closed end;

a mirror housing recess or bore is formed in the elongated housing, said recess or bore receives a projecting portion of the mirror housing;

a laser received within said longitudinally directed passage adjacent said first end of said elongated housing for generating a laser beam;

a mirror received within said mirror housing, said mirror reflecting said laser beam through said aperture in a direction substantially orthogonal to a longitudinal axis of said elongated housing, wherein said laser beam is projected onto a leading foot of a user in order to properly position the user when said longitudinal axis of said elongated housing is aligned with a selected target.

2. The golf training device as recited in claim 1 wherein indicia are imprinted an outer surface of said elongated housing, said indicia denoting positions for placement of a golf ball dependent upon a choice of golf club.

3. The golf training device as recited in claim 2 wherein said indicia include a directional pointer for aligning said elongated housing with said target.

4. The golf training device as recited in claim 1 wherein a transparent window is received within said aperture.

5. The golf training device as recited in claim 1 wherein said elongated housing has a hexagonal cross-sectional contour.

6. The golf training device as recited in claim 1 further comprising a push button actuator received within said first end of said elongated housing, a first end of said push button actuator contacting said laser for actuation thereof, and an opposed second end projecting external to said elongated housing.

7. The golf training device as recited in claim 6 wherein an elastic element is mounted between said push button actuator and said laser.

8. A golf training device comprising:

an elongated housing having first and second longitudinally opposed ends defining a longitudinally directed passage, said elongated housing having an aperture formed therethrough adjacent said second end;

a laser received within said longitudinally directed passage adjacent said first end of said elongated housing for generating a laser beam;

a mirror received within said second end of said elongated housing, said mirror reflecting said laser beam through said aperture in a direction substantially orthogonal to a longitudinal axis of said elongated housing, wherein said laser beam is projected onto a leading foot of a user in order to properly position the user when said longitudinal axis of said elongated housing is aligned with a selected target; and, a pair of projecting spikes secured to said elongated housing, said pair of projecting spikes being insertable into the ground and providing support for said elongated housing.

9. The golf training device as recited in claim 8 wherein said pair of projecting spikes are pivotally and collapsibly secured to said elongated housing.

10. A golf training device comprising:

an elongated housing having first and second longitudinally opposed open ends defining a longitudinally directed passage, first and second annular bores being formed within said elongated housing adjacent said first and second open ends, respectively;

a laser received within said longitudinally directed passage adjacent said first open end of said elongated housing for generating a laser beam;

a push button actuator being received within said first open end and contacting said laser for actuation thereof;

a retaining ring having a projecting portion, said retaining ring receiving said push button actuator and said projecting portion being received within said first annular bore for securing said push button actuator to said elongated housing.

a hollow minor housing having an open end and a closed end, said hollow mirror housing having an aperture formed therethrough and having an annular connecting region, said annular connecting region being received within said second annular bore of said elongated housing;

a mirror received within said hollow mirror housing, said mirror reflecting said laser beam through said aperture in a direction substantially orthogonal to a longitudinal axis of said elongated housing, wherein said laser beam is projected onto a leading foot of a user in order to properly position the user when said longitudinal axis of said elongated housing is aligned with a selected target.

11. The golf training device as recited in claim 10 wherein said annular connecting region of said hollow mirror housing having a first annular recess formed therein.

12. The golf training device as recited in claim 11 further comprising a gasket received within said first annular recess of said hollow mirror housing.

13. The golf training device as recited in claim 12 wherein a second annular recess is formed in an interior end wall of said elongated housing, said interior end wall defining said second annular bore, said gasket engaging said second annular recess.

14. The golf training device as recited in claim 10 wherein said hollow mirror housing is rotatable with respect to said elongated housing.

15. The golf training device as recited in claim 10 wherein indicia are imprinted on an exterior surface of said elongated housing, said indicia denoting positions for placement of a golf ball dependent upon a choice of golf club.

16. The golf training device as recited in claim 15 wherein said indicia include a directional pointer for aligning said elongated housing with said target.

17. The golf training device as recited in claim 10 wherein a pair of projecting spikes are secured to said elongated housing, said pair of projecting spikes being insertable into the ground and providing support for said elongated housing.

18. The golf training device as recited in claim 17 wherein said pair of projecting spikes are pivotally and collapsibly secured to said elongated housing.

19. The golf training device as recited in claim 18 wherein each of said projecting spikes includes a mounting bracket for securement to said elongated housing and an elongated projecting member having a first end being insertable into the ground and having a second end pivotally connected to said mounting bracket.

20. The golf training device as recited in claim 10 wherein a transparent window is received within said aperture.

21. The golf training device as recited in claim 10 wherein said elongated housing has a hexagonal cross-sectional contour.

22. The golf training device as recited in claim 10 wherein an elastic element is mounted between said push button actuator and said laser.

23. The golf training device as recited in claim 10, wherein said laser beam further generates a reference point on the ground in front of said user for aligning said leading foot of said user.

* * * * *